US010312618B2

(12) United States Patent
Enomoto et al.

(10) Patent No.: US 10,312,618 B2
(45) Date of Patent: Jun. 4, 2019

(54) CONNECTOR TERMINAL AND MANUFACTURING METHOD THEREOF

(71) Applicant: NIPPON TANSHI CO., LTD., Kanagawa (JP)

(72) Inventors: Shinya Enomoto, Kanagawa (JP); Osamu Nishimura, Kanagawa (JP)

(73) Assignee: NIPPON TANSHI CO., LTD., Kanagawa (JP)

( * ) Notice: Subject to any disclaimer, the term of this patent is extended or adjusted under 35 U.S.C. 154(b) by 0 days.

(21) Appl. No.: 15/769,089

(22) PCT Filed: Oct. 17, 2016

(86) PCT No.: PCT/JP2016/080668
§ 371 (c)(1),
(2) Date: Apr. 18, 2018

(87) PCT Pub. No.: WO2017/069076
PCT Pub. Date: Apr. 27, 2017

(65) Prior Publication Data

US 2018/0309217 A1 Oct. 25, 2018

(30) Foreign Application Priority Data

Oct. 20, 2015 (JP) ..... 2015-206055

(51) Int. Cl.
*H01R 13/648* (2006.01)
*H01R 13/11* (2006.01)
(Continued)

(52) U.S. Cl.
CPC ..... *H01R 13/11* (2013.01); *H01R 12/721* (2013.01); *H01R 12/91* (2013.01);
(Continued)

(58) Field of Classification Search
CPC ..... H01R 13/11; H01R 43/16; H01R 12/721
(Continued)

(56) References Cited

U.S. PATENT DOCUMENTS 3,742,430 A * 6/1973 Cairns ..... H01R 12/721 439/862
5,083,936 A * 1/1992 Yang ..... H01R 13/115 439/441
(Continued)

FOREIGN PATENT DOCUMENTS

JP 06188040 A * 7/1994 ..... H01R 43/20
JP 2009093806 4/2009
(Continued)

OTHER PUBLICATIONS

International Search Report for PCT/JP2016/080668 dated Nov. 16, 2016, 4 pages.
(Continued)

*Primary Examiner* — Abdullah A Riyami
*Assistant Examiner* — Nelson R. Burgos-Guntin
(74) *Attorney, Agent, or Firm* — Dority & Manning, P.A.

(57) ABSTRACT

A connector terminal (10) is provided with a housing (14) for slidably guiding the connector terminal (10) over a conductive surface (92) of a board side terminal (90), and a spring piece (34) supported by the housing (14) so as to resiliently contact the conductive surface (92), and the spring piece (34) is configured in such a manner that a contact portion (48) of the spring piece (34) moves into a path of movement of the conductive surface (92) to serve as a contact portion (48) for electric contact with the board side terminal (90) as a pressing portion (46) of the spring piece is pressed by the conductive surface (92) owing to a sliding movement of the connector terminal (10) relative to the board side terminal (90).

10 Claims, 13 Drawing Sheets

(51) Int. Cl.

| | |
|---|---|
| ***H01R 43/16*** | (2006.01) |
| ***H01R 12/72*** | (2011.01) |
| ***H01R 12/91*** | (2011.01) |
| ***H01R 13/24*** | (2006.01) |
| ***H01R 13/26*** | (2006.01) |

(52) U.S. Cl.
CPC ..... *H01R 13/2492* (2013.01); *H01R 13/26* (2013.01); *H01R 43/16* (2013.01)

(58) Field of Classification Search
USPC ..... 439/816, 862, 737, 736
See application file for complete search history.

(56) References Cited

U.S. PATENT DOCUMENTS

| | | | | |
|---|---|---|---|---|
| 5,281,175 | A * | 1/1994 | Chupak | H01R 13/113 439/839 |
| 5,660,569 | A * | 8/1997 | Yamada | H01R 13/115 428/209 |
| 6,679,739 | B2 * | 1/2004 | Fujita | H01R 13/11 439/637 |
| 7,131,875 | B2 * | 11/2006 | Kodaira | H01R 13/2442 439/862 |
| 8,298,021 | B2 * | 10/2012 | Huang | H01R 13/2492 439/500 |
| 8,517,780 | B2 * | 8/2013 | Yu | H01R 12/57 439/862 |
| 8,696,382 | B2 * | 4/2014 | Patel | H01R 12/58 439/607.1 |
| 9,331,411 | B2 * | 5/2016 | Endo | H01R 13/02 |
| 9,685,745 | B2 * | 6/2017 | Endo | H01R 24/38 |
| 2002/0064988 | A1 | 5/2002 | Fujita et al. | |
| 2005/0059303 | A1 * | 3/2005 | Panella | H01R 13/2435 439/862 |
| 2013/0316586 | A1 | 11/2013 | Nagamine | |

FOREIGN PATENT DOCUMENTS

| | | |
|---|---|---|
| JP | 2014003007 | 1/2014 |
| JP | 5922295 | 5/2016 |
| WO | WO 2012095336 | 7/2012 |

OTHER PUBLICATIONS

European Search Reported for PCT/JP2016/080668 dated Oct. 15, 2018, 12 pages.

* cited by examiner

CONNECTOR TERMINAL AND MANUFACTURING METHOD THEREOF

CROSS REFERENCE TO RELATED APPLICATIONS

This application is the U.S. National Stage entry of International Application Number PCT/JP2016/080668 filed under the Patent Cooperation Treaty having a filing date of Oct. 17, 2016, which claims priority to Japanese Patent Application Number 2015-206055 having a filing date of Oct. 20, 2015, which are incorporated herein by reference.

TECHNICAL FIELD

The present invention relates to a connector terminal and a manufacturing method thereof, and more particularly to a slide type connector terminal used for a card edge connector and the like and a manufacturing method thereof.

BACKGROUND ART

A known card edge connector for connection with card edge terminals (board side terminals) is provided with a plurality of connector terminals each consisting of a housing having a rectangular cross section and defining an outer profile of the connector terminal so as to guide a sliding movement of the connector terminal relative to the corresponding card edge terminal, and a spring piece connected to the housing and provided with a contact portion configured to establish an electric connection with a conductive portion of the corresponding card edge terminal by contacting the same. (See Patent Document 1, for example.)

PRIOR ART DOCUMENT(S)

Patent Document(s)

Patent Document 1: JP2014-3007A

SUMMARY OF THE INVENTION

Task to be Accomplished by the Invention

In a free state of the aforementioned connector terminals or when the connector terminals are not connected to the card edge terminals, the contact portion of each connector terminal protrudes out of the housing. Therefore, at the time of assembly or the like, the spring piece could be deformed if the contact portion hits an object. A deformation of the spring piece could be a cause of a poor conduction between the connector terminal and the card edge terminal.

When a rubber seal member is placed in the connector for waterproofing, each connector terminal is required to be passed through a through hole formed in the seal member for passing the lead wire so that the contact portion inevitably contacts the inner circumferential surface of the through hole as the connector terminal is pushed through the through hole. Therefore, a release agent or a lubricating agent consisting of silicone oil which may be deposited on the inner circumferential surface of the through hole may be transferred onto the surface of the contact portion. A foreign matter such as a release agent and a lubricating agent deposited on the contact portion may cause a conduction failure between the connector terminal and the card edge terminal.

A primary object of the present invention is to prevent deformation of a spring piece of a connector terminal provided with a contact portion from deforming during assembly work, and deposition of foreign matter on the surface of the contact portion that could cause a conduction failure so that a favorable electric conduction may be ensured in a reliable manner.

Means for Accomplishing the Task

To achieve such an object, the present invention provides a connector terminal (10) configured to be electrically connected to an object terminal (90) by making a sliding engagement with a planar surface (92) including the object terminal, the connector terminal comprising: a housing (14) configured to slide over the object terminal (90); and a spring piece (34) connected to the housing (14), the spring piece (34) including a pressing portion (46) which is configured to be located outside of the housing (14) in a free state of the spring piece (34), and to move into the housing (14) owing to an elastic deformation of the spring piece (34) when the pressing portion (46) is pressed by the planar surface (92), and a contact portion (48) which is configured to be located inside of the housing (14) in the free state of the spring piece (34), and to move out of the housing (14) and make an electric contact with the object terminal (90) as the pressing portion (46) moves into the housing (14).

Because the contact portion (48) is located inside of the housing (14) in the free state of the spring piece, deformation of the spring piece (34) owing to an external force applied to the contact portion (48) can be avoided, and foreign matter is prevented from adhering to the contact portion (48). Therefore, failure in electric conduction can be avoided, and a reliable electric connection can be achieved.

The object terminal may comprise a board side terminal (90) formed in a printed circuit board (94) and having a conductive surface (92) serving as the planar surface.

Preferably, the housing (14) comprises a support portion (54) supporting a portion located between the pressing portion (46) and the contact portion (48) of the spring peace (34) as a fulcrum, the pressing portion (46) serving as an effort point, and the contact portion (48) serving as a load point.

Thereby, a lever having a fulcrum at a point located between the pressing portion (46) and the contact portion (48), an effort point at the pressing portion (46) and a load point at the contact portion (48) is formed so that when the pressing portion (46) is pressed, the contact portion (48) moves out of the housing (14) and comes into electric contact with the object terminal (90) under a lever action in a highly repeatable manner.

Preferably, in the connector terminal of the present invention, the support portion (54) comprises a sloping surface (58) rising toward the pressing portion (46) of the spring piece (34), and the spring piece (34) is pivotally supported by the housing (14) at an intermediate portion (50) of the spring piece (34) serving as a fulcrum and located between the pressing portion (46) and the contact portion (48), and slidably engaged by the sloping surface (58).

Thereby, as the contact portion (48) moves out of the housing (14), the contact point between the intermediate portion (50) and the sloping surface (58) moves in an outward direction from the housing (14) so that the pressure applied by the contact portion (48) onto the planar surface (92) progressively increases, and a high contact pressure can be achieved between the contact portion (48) and the planar surface (92).

Preferably, in the connector terminal of the present invention, the housing (14) comprises a rectangular bottom piece (16) and a pair of side vertical pieces (18, 20) extending along either side edge of the bottom piece (16), and the support portion comprises an opening (54) provided in each side vertical piece, and the intermediate portion of the spring piece comprises an extension (50) extending laterally from the spring piece and engaged by the opening (54).

Thereby, the spring piece (36) can be pivotally supported in a highly simple manner without requiring a pivot shaft or the like.

Preferably, in the connector terminal of the present invention, the pressing portion (46) is configured to serve as an additional contact point for electric contact with the object terminal (90) when the pressing portion (46) is pressed by the planar surface (92).

Thereby, the pressing portion (46), in addition to the contact portion (48), also contributes to an electric connection with the object terminal (60) so that the reliability of electric connection can be enhanced.

Preferably, in the connector terminal of the present invention, the housing (14) comprises a slot (22) defined by a rectangular bottom piece (16) and a pair of side vertical pieces (18, 20) extending along either side edge of the bottom piece (16), the contact portion (48) being configured to be received in the slot (22) in the free state of the spring piece.

Thereby, because the contact portion (48) is received in the slot (22) in the free state of the spring piece, the contact portion (48) is prevented from being deformed owing to an inadvertent application of an external force to the contact portion (48), and foreign matter is prevented from being deposited on the contact portion (48).

Preferably, in the connector terminal of the present invention, the spring piece (34) comprises a base end portion (36) fixedly attached to the housing (14), and extends from the base end portion (36) toward the pressing portion (46) in a sliding direction in relation to the object terminal (90), and is folded back so as to extend from the pressing portion (46) to the contact portion (48) in an opposite sliding direction in relation to the object terminal (90).

Thereby, a hairpin shaped portion (44) is produced by the spring piece (34) so that the movement of the contact portion (48) out of and into the housing (14) in response to the pressing and releasing of the pressing portion (46) can be achieved in a highly repeatable manner under the elastic deformation of the hairpin shaped portion (44).

Preferably, in the connector terminal of the present invention, the housing (14) and the spring piece (36) are formed as a single integral member.

Thereby, the number of component parts can be reduced, and the need for an assembly work can be eliminated.

The present invention also provides a method of manufacturing the connector terminal (10) defined above, wherein the method comprises: a blanking step of blanking a sheet material into a blank (W) having a developed flat shape containing an entirety of the connector terminal (10); and a bending step of bending the blank (W) into the connector terminal.

Thereby, the connector terminal (10) can be produced both efficiently and economically by performing the blanking step for obtaining the blank (W), and the bending step for bending the blank (W).

The present invention also provides a connector terminal (10) configured to be electrically connected to a board side terminal (90) having a conductive surface (92), the connector terminal (10) comprising: a spring piece (34) provided with a contact portion (48) configured to resiliently contact the conductive surface (92) of the board side terminal (90) when the connector terminal (10) is at a connection completion position where connection of the connector terminal (10) with the board side terminal (90) is completed; and a housing (14) configured to support the spring piece (34) and to guide a sliding movement of the connector terminal (10) along the conductive surface (92) of the board side terminal (90) toward the connection completion position, wherein the spring piece (34) further includes a pressing portion (46) that, in a free state where no external force is applied to the pressing portion (46), is positioned to intrude into a path of movement taken by the conductive surface (92) of the board side terminal (90) when the connector terminal (10) slides along the conductive surface (92) toward the connection completion position, wherein, in the free state of the pressing portion (46), the contact portion (48) is positioned such that the contact portion (48) does interfere with the path of movement of the conductive surface (92) of the board side terminal (90), and wherein the spring piece (34) is configured in such a manner that when, during the sliding movement of the connector terminal (10) relative to the board side terminal (90) toward the connection completion position, the pressing portion (46) is pressed by the conductive surface (92), the contact portion (48) is moved toward the conductive surface (92) to make a resilient contact with the conductive surface (92).

Because the contact portion (48) is located within the housing (14) in the free state, deformation of the spring piece (34) owing to an external force applied to the contact portion (48) can be avoided, and foreign matter is prevented from adhering to the contact portion (48). Therefore, failure in electric conduction can be avoided, and a reliable electric connection can be achieved.

The present invention also provides a connector terminal (10) configured to be electrically connected to a board side terminal (90) provided with a conductive surface (92) by making a sliding engagement with the conductive surface (92), the connector terminal (10) comprising: a housing (14) configured to slide over the board side terminal (90); and a spring piece (34) supported by the housing (14) and configured to resiliently contact the conductive surface (92), the spring piece (34) including a base end portion (36) fixedly attached to the housing (14), an intermediate portion (46) configured to move into a path of movement of the conductive surface (92) as the housing (14) slide over the board side terminal (90) in a free state of the spring piece (34), and a free end portion (48) configured to be positioned out of the path of movement of the conductive surface (92) as the housing (14) slide over the board side terminal (90) in the free state of the spring piece (34) where no external force is applied, the spring piece (34) being configured in such a manner that the free end portion (48) moves into the path of movement of the conductive surface (92) to serve as a contact portion (48) for electric contact with the board side terminal (90) as the intermediate portion (46) is pressed by the conductive surface (92) owing to a sliding movement of the connector terminal (10) relative to the board side terminal (90).

Because the free end portion (48) is located out of the path of movement of the conductive surface (92), deformation of the spring piece (34) owing to an external force applied to the contact portion (48) can be avoided, and foreign matter is prevented from adhering to the contact portion (48).

Therefore, failure in electric conduction can be avoided, and a reliable electric connection can be achieved.

Effect of the Invention

According to the connector terminal of the present invention, the spring piece provided with the contact portion is prevented from being deformed during the assembly work or the like, and deposition of foreign matter on the surface of the contact portion that could cause a conduction failure is avoided so that a favorable electric conduction may be ensured in a reliable manner.

DETAILED DESCRIPTION OF THE PREFERRED EMBODIMENT(S)

Figure 1:
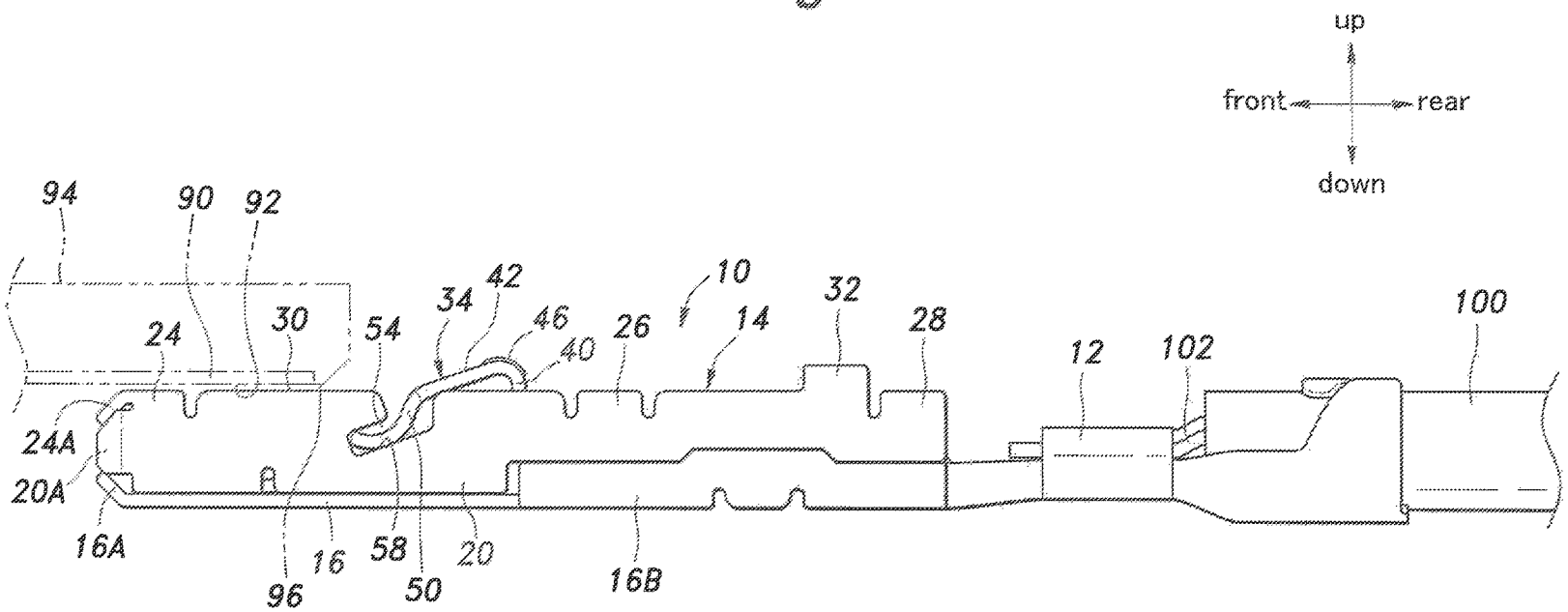
FIG. 1 is a right side view of a connector terminal according to a first embodiment of the present invention.

A connector terminal according to a first embodiment of the present invention will be described in the following with reference to FIGS. 1 to 7. In the following description, directions such as vertical, front, rear, left and right are defined as indicated in the drawings, and the surface of the connector terminal on which the mating terminal makes a sliding contact is referred to as the upper surface, but this is only for convenience of explanation, and does not limit the scope of the present invention.

Figure 2:
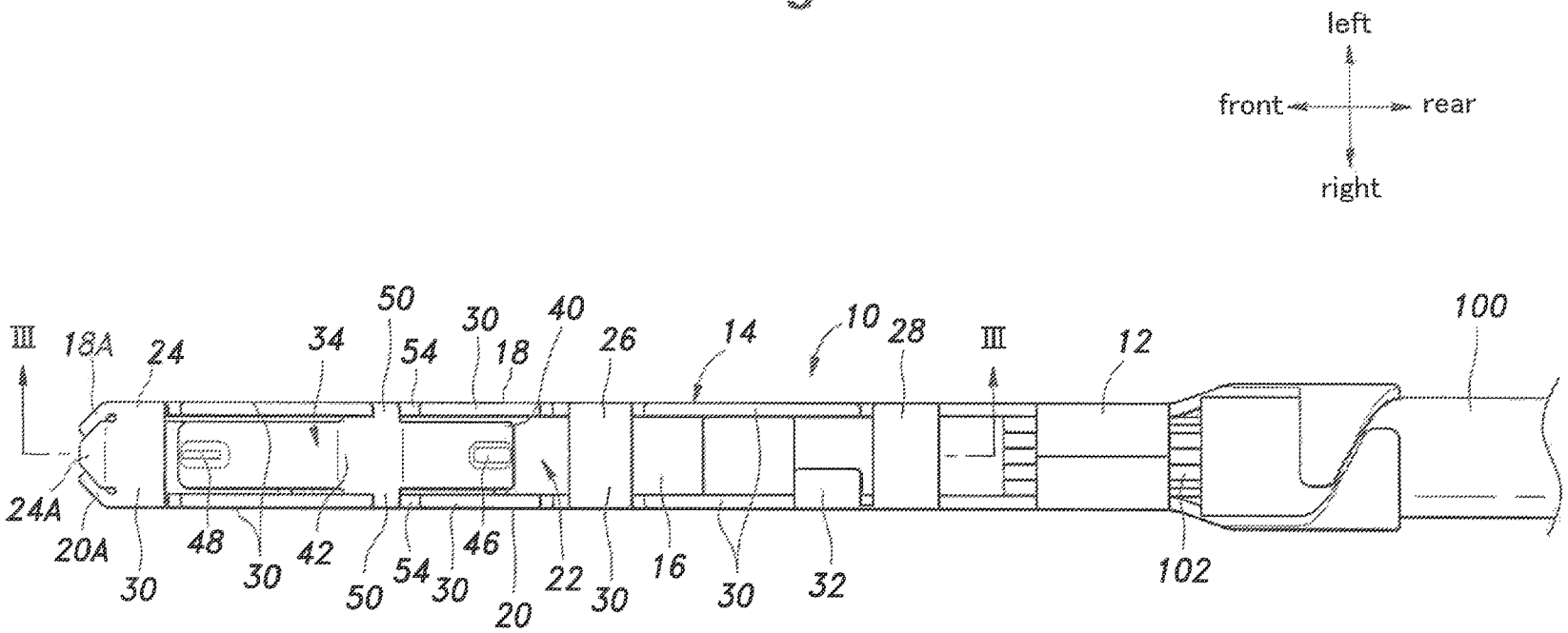
FIG. 2 is a plan view of the connector terminal of the first embodiment of the present invention.
Figure 6:
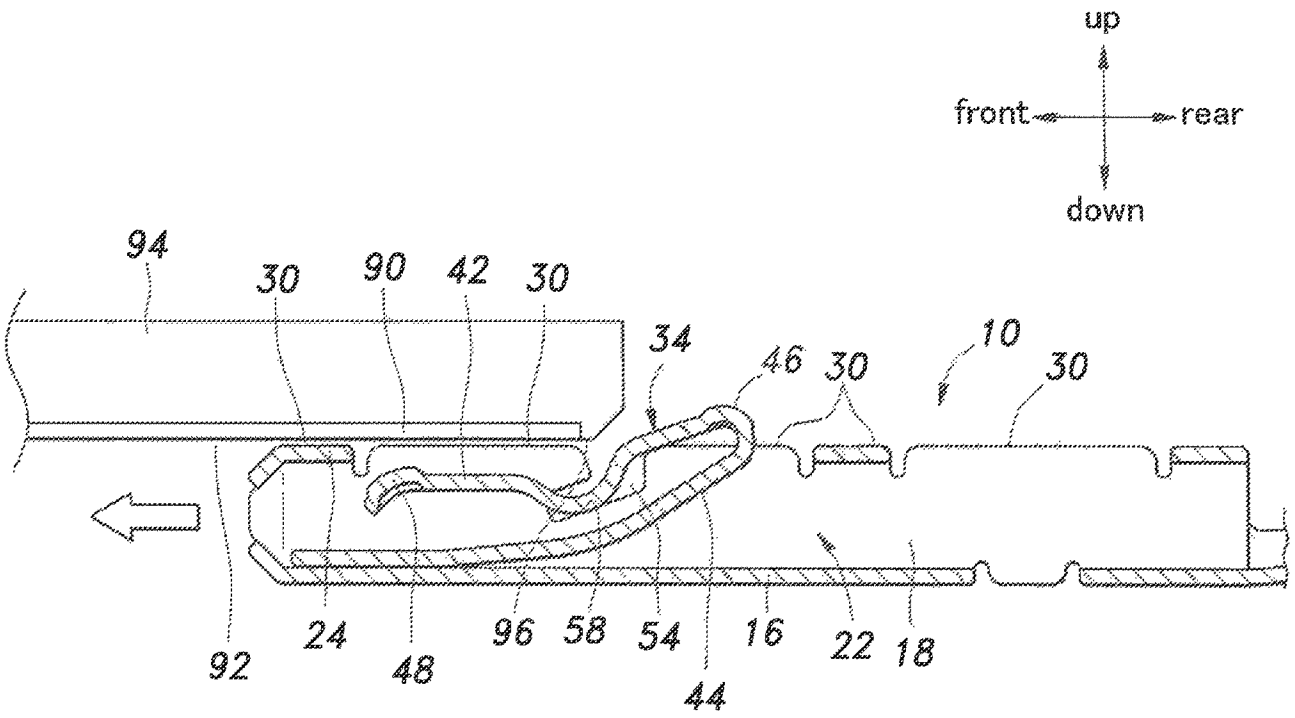
FIG. 6 is a fragmentary sectional view of the connector terminal of the first embodiment of the present invention in an initial stage of connection.

The connector terminal 10 is designed for use in a card edge connector. As shown in FIGS. 1, 2, and 6, a mating connector terminal for the connector terminal 10 consists of a board side terminal 90 (card edge terminal) formed on a board surface 96 of a printed circuit board 94 (hereinafter referred to simply as the board 94). The board side terminal 90 has a planar conductive surface 92 which is flush with the board surface 96.

The connector terminal 10 consists of a slide type terminal which is electrically connected to the board side terminal 90 by sliding in the fore and aft direction along the board surface 96 of the board 94 and the conductive surface 92 of the board side terminal 90.

Figure 4:
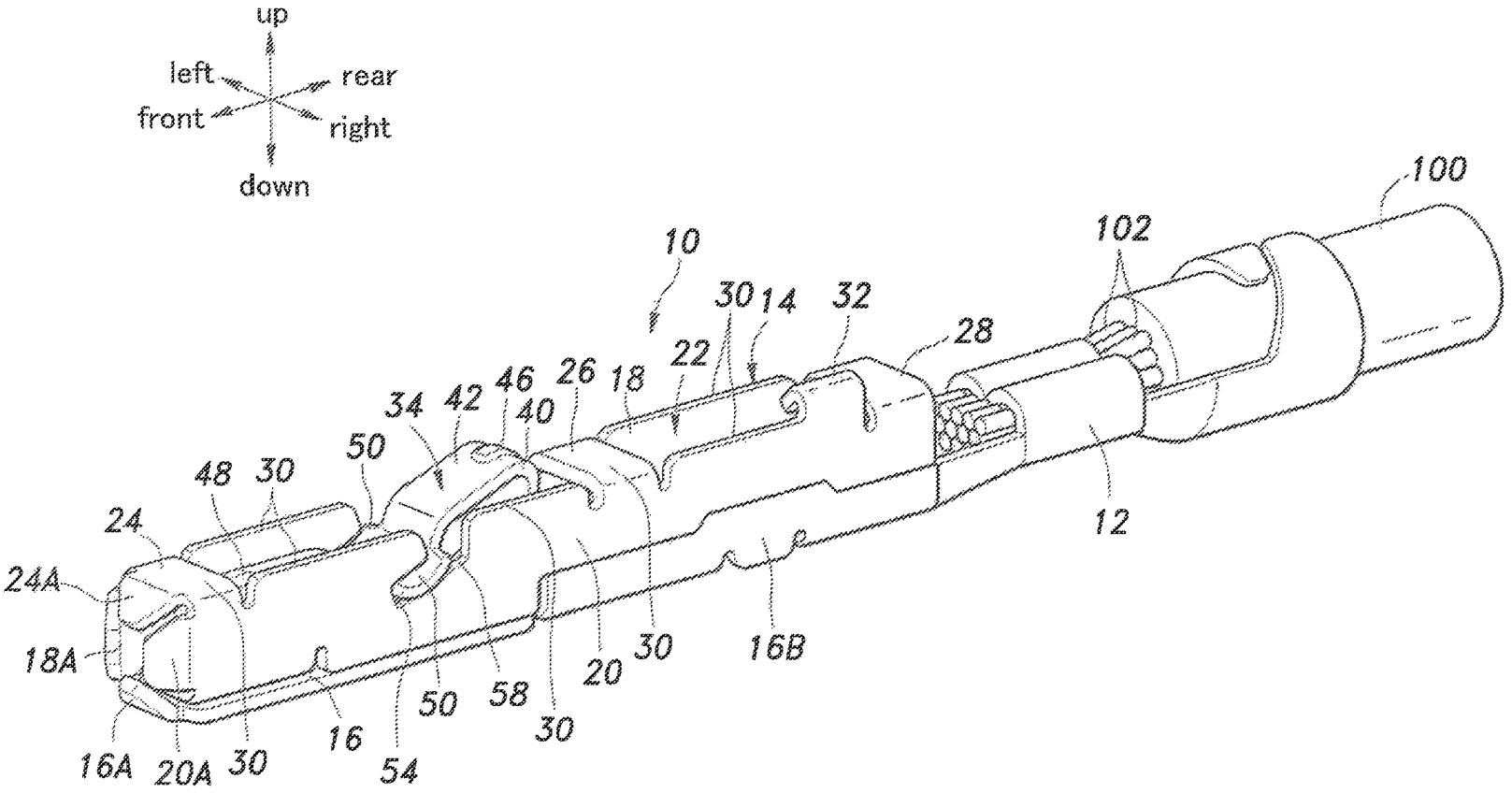
FIG. 4 is a perspective view of the connector terminal of the first embodiment of the present invention.
Figure 5:
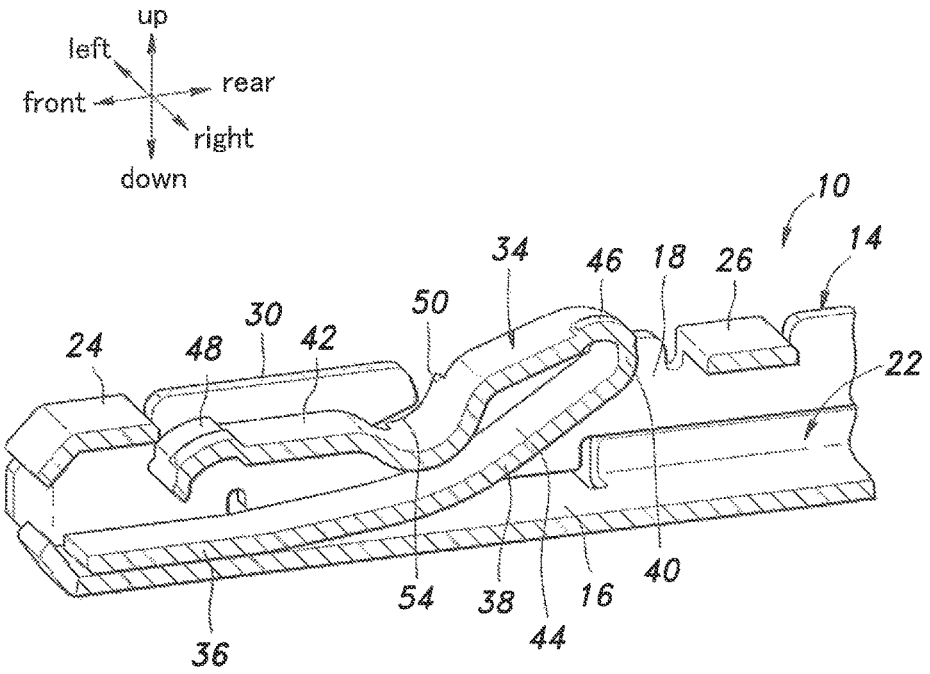
FIG. 5 is a fragmentary sectional perspective view of the connector terminal of the first embodiment of the present invention.

As shown in FIGS. 1, 2, and 4, the connector terminal 10 includes a cable connecting portion 12 which is electrically connected to a conductor 102 of a cable 100, a housing 14 located on the front side of the cable connecting portion 12 to guide the sliding movement of the connector terminal 10 with respect to the board side terminal 90, and a spring piece 34 that is supported by the housing 14 to resiliently contact the conductive surface 92 and the board surface 96.

The housing 14 is provided with a rectangular bottom piece 16 elongated in the sliding direction (fore and aft direction) with respect to the conductive surface 92 of the board side terminal 90, and a right side vertical piece 18 and a left side vertical piece 20, 16B extending along the left and right side edges of the bottom piece 16, respectively. Thereby, a slot (channel shaped portion) 22 having an upper open end is formed. The upper edge of the right side vertical piece 18 and the upper edge of the left side vertical piece 20 are connected to each other at front portions, intermediate portions and rear portions thereof by connecting pieces 24, 26 and 28, respectively. The bottom piece 16, the right side vertical piece 18, the left side vertical piece 20, and the connecting piece 24 are provided with front end pieces 16A, 18A, 20A and 24A bent from the respective front ends thereof toward one another so as to define a square pyramid defining a pointed tip end.

Figure 7:
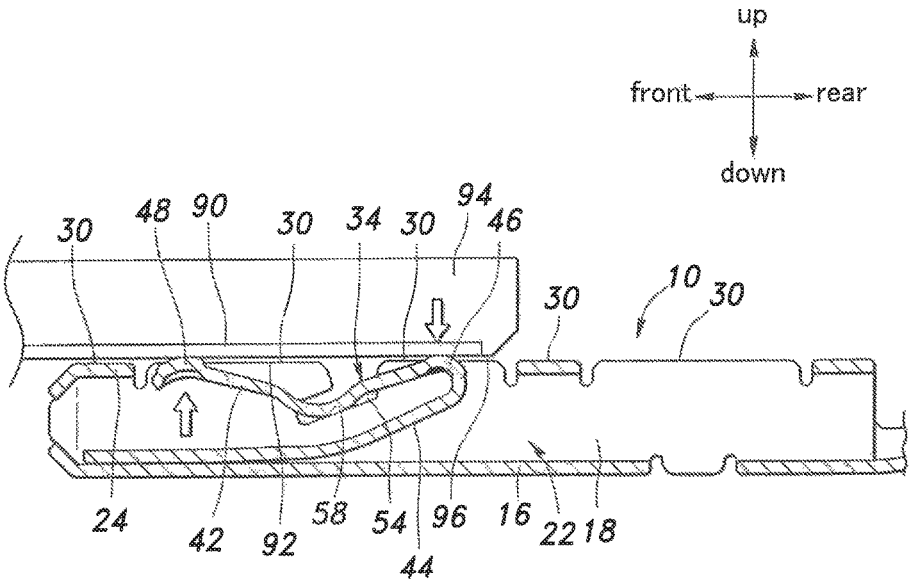
FIG. 7 is a fragmentary sectional view of the connector terminal of the first embodiment of the present invention in a final stage of connection.

The upper end surfaces of the right side vertical piece 18 and the left side vertical piece 20, and the upper surfaces of the connecting pieces 24 and 26 are flush with one another, and jointly define a slide surface 30 configured to slide over the conductive surface 92. The connector terminal 10 is disposed with respect to the board 94 such that the slide surface 30 slides over the conductive surface 92 of the board side terminal 90 and the board surface 96 in a parallel relationship. A connector housing or the like that retains the board side terminal 90 may be provided with a slide guide (not shown in the drawings) that guides the connector terminal 10 in such a manner that the slide surface 30 does not contact the board surface 96 as the housing 14 is moved along the board side terminal 90 as shown in FIGS. 1, 6 and 7.

A part of the left side vertical piece 20 adjoining the front edge of the rear connecting piece 28 is integrally provided with a projecting piece 32 projecting upward beyond the slide surface 30.

As shown in FIGS. 3 and 5 to 7, the spring piece 34 includes a base end portion 36 (see FIG. 11) bent from the lower edge of a front end part of the left side vertical piece 20 and laid onto the bottom piece 16 so as to extend in the sliding direction for the conductive surface 92 (in the fore and aft direction), a lower piece 38 extending rearward (a first sliding direction with respect to the board side terminal 90) from the base end portion 36 in an obliquely upward direction, and an upper piece 42 bent forward from the rear end of the lower piece 38 via a semi-cylindrical folded-back portion 40 in such a manner that a hairpin shaped portion 44 is formed. Owing to this structure, the housing 14 and the spring piece 34 can be integrally formed by stamp forming a single piece of piece metal, without requiring a plurality of component pieces and the assembling of component pieces.

The folded-back portion 40 generally defines a rear end part of the spring piece 34. An upper end part of the folded-back portion 40 is formed with a pressing portion 46 by stamp forming as an upwardly projecting track shaped projection. The free end or the front end of the upper piece 43 is also formed with contact portion 48 by stamp forming as an upwardly projecting track shaped projection. The contact portion 48 is configured to contact the corresponding board side terminal 90 (see FIGS. 6 and 7).

An intermediate part of the upper piece 42 located between the pressing portion 46 and the contact portion 48 is provided with a lateral extension 50 extending outwardly from the side edges of the upper piece 42. The extension 50 is formed in a semi-cylindrical shape with a convex side thereof facing downward, and is configured to serve as a pivot point or a fulcrum for the spring piece 34 relative to the housing 14. The right side vertical piece 18 and the left side vertical piece 20 are each formed with an opening 54 (a cutout) having an open upper end. In particular, an upwardly facing surface 58 defining a lower edge of the opening 54 slopes upward toward the rear or toward the folded-back portion 40 of the spring piece 34. The extension 50 rests upon the upwardly facing surface 58 of the opening 54 of the right side vertical piece 18 and the left side vertical piece 20 so as to be pivotable and slidable in the fore and aft direction. Thus, the openings 54 serve as a fulcrum point that supports an intermediate point of the upper piece 42 located between the contact portion 48 and the pressing portion 46. Thus, a lever mechanism including an effort point located at the pressing portion 46 and a load point located at the contact portion 48 is formed. This lever mechanism is formed in a highly simple manner without requiring a pivot shaft or the like. In particular, the contact portion 48 is entirely received in the slot 22, and is positioned below the slide surface 30.

In a free state where the hairpin shaped portion 44 is not pressed downward, as shown in FIGS. 2 to 6, the pressing portion 46 is located outside the housing 14 or more importantly, positioned above the slide surface 30. During the process of connecting the connector terminal 10 to the board side terminal 90, the pressing portion 46 is located in the way of the conductive surface 92 as the conductive surface 92 moves along the slide surface 30 with the result that the pressing portion 46 is pressed downward under pressure from the conductive surface 92. This causes the upper piece 42 to rotate in clockwise direction in FIG. 7 around the extension 50 and deflect downward while the hairpin shaped portion 44 undergoes a corresponding elastic deformation. As a result, the pressing portion 46 is received into the slot 22.

In the free state where the pressing portion 46 is not pressed downward, the contact portion 48 is entirely received in the slot 22 and is located below the slide surface 30 as shown in FIGS. 2 to 6 so that the contact portion 48 does not interfere with the path of the movement of the conductive surface 92 during the process of connecting the connector terminal 10 to the board side terminal 90. When the pressing portion 46 is pressed downward in the process of connecting the connector terminal 10 to the board side terminal 90, as shown in FIG. 7, the upper piece 42 is rotated in the clockwise direction around the extension 50 which provides a fulcrum point while the hairpin shaped portion 44 is elastically deformed so that the contact portion 48 moves upward from the slot 22, in particular to a position above the slide surface 30. As a result, the contact portion 48 moves to a position that interferes with the path of movement of the conductive surface 92 so that the contact portion 48 resiliently comes into contact with conductive surface 92 of the board side terminal 90, and is electrically connected to the board side terminal 90.

In summary, the connector terminal 10 is provided with a spring piece 34 formed with a contact portion 48 that resiliently contacts the conductive surface 92 of the board side terminal 90 when the connector terminal 10 is in the connection completion position where the connection of the connector terminal 10 to the board side terminal 90 is completed, and a housing 14 supporting the spring piece 34 and configured to guide the sliding movement of the connector terminal 10 along the conductive surface 92 of the board side terminal 90 toward the connection completion position. The spring piece 34 is provided with a pressing portion 46 that, in a free state where no external force is applied thereto, intrudes into the path of movement of taken by the conductive surface 92 as the connector terminal 10 slides along the conductive surface 92 of the board side terminal 90 toward the connection completion position. When the pressing portion 46 is in the free state thereof, the contact portion 48 is positioned so as not to interfere with the path of movement of the conductive surface 92 of the board side terminal 90. When the pressing portion 46 is pressed by the conductive surface 92 as the connector terminal 10 slides along the conductive surface 92 toward the connection completion position, the contact portion 48 is displaced toward the conductive surface 92 to come into a resilient contact with the conductive surface 92.

Next, the mode of operation in connecting the connector terminal 10 to the board side terminal 90 will be described in the following with reference to FIGS. 6 and 7.

FIG. 6 shows a free state where the pressing portion 46 is not in contact with the board surface 96 of the board 94 or the conductive surface 92 in an initial stage of connection. In this free state, the contact portion 48 is entirely received in the slot 22, and is located below the slide surface 30 so as not to interfere with the path of movement of the conductive surface 92. Therefore, deformation of the contact portion 48 due to an external force can be avoided, and deposition of foreign matter on the surface of the contact portion 48 can be minimized. As a result, a faulty contact of the contact portion 48 owing to such causes can be avoided, and a connection can be achieved in a highly reliable manner.

As shown in FIG. 7, as the connector terminal 10 progressively slides forward along the board 94, the pressing portion 46 comes into contact with the board surface 96 of the board 94 and the conductive surface 92 with the result that the pressing portion 46 is pressed downward. Thereby, the upper piece 42 rotates in the clockwise direction like a lever having a fulcrum provided by the extension 50 while the hairpin shaped portion 44 undergoes an elastic deformation with the result that the pressing portion 46 is received into the slot 22. This rotational movement of the upper piece 42 causes the contact portion 48 to move vertically away from the slot 22 or to a position above the slide surface 30. In other words, the contact portion 48 is brought to a position that interferes with the path of movement of the conductive surface 92. As a result, the contact portion 48 resiliently contacts the conductive surface 92 of the board side terminal 90, and an electric connection is established between the connector terminal 10 and the board side terminal 90.

Because the contact portion 48 resiliently contacts the conductive surface 92 of the board side terminal 90 only after the pressing portion 46 is pressed downward by the board surface 96 and the conductive surface 92, the contact portion 48 and the conductive surface 92 are brought into contact with each other over only a small part of the entire stroke of the sliding movement of the connector terminal 10 relative to the board 94 so that the wear of the contact portion 48 and the conductive surface 92 can be minimized. Also, the contact portion 48 is prevented from being abraded or otherwise damaged by the edge of the board 94. Therefore, even after the connector is connected and disconnected by a large number of times, the terminals can continue to operate in a satisfactory manner.

The distance along which the contact portion 48 and the conductive surface 92 are in sliding contact with each other can be determined by appropriately selecting the timing of actuating the spring piece 34. If a wiping effect (removal of oxide film on the connector terminal 10) is desired, this sliding distance can be selected in a corresponding manner.

Because the movement of the upper piece 42 discussed above is effected by the lever action having a fulcrum positioned at the extension 50, the path of movement of the contact portion 48 due to the downward movement of the pressing portion 46 is uniquely determined. In other words, the movement of the contact portion 48 into the path of movement of the conductive surface 92 can be effected in a highly repeatable manner owing to the lever action. Therefore, even after the connector is connected and disconnected by a large number of time, it is still ensured that the contact portion 48 is brought into contact with the conductive surface 92 of the board side terminal 90 in a precise manner.

Because the upward rotational movement of the upper piece 42 around the fulcrum point provided by the extension 50 is performed under the elastic deformation of the hairpin shaped portion 44 having the fixed base end portion 36, the contact point between the extension 50 and the upwardly facing surface 58 moves upward and rearward as the upper piece 42 rotates in clockwise direction so that the pressure of the contact portion 48 onto the conductive surface 92 increases, and the contact between the contact portion 48 and the conductive surface 92 becomes firmer during this process. In other words, the electric connection between the connector terminal 10 and the board side terminal is achieved with a high contact pressure. Furthermore, because a relatively large vertical travel of the contact portion 48 can be achieved in spite of a small lever length of the upper piece 42, the size (length) of the connector terminal 10 can be minimized owing to the reduction in the lever length of the upper piece 42.

When the contact portion 48 resiliently contacts the conductive surface 92, the pressing portion 46 also resiliently contacts the conductive surface 92 as shown in FIG. 7 so that the pressing portion 46 also contributes to the electric connection with the board side terminal 90. This enhances the reliability of the electric connection.

When the connector terminal 10 is displaced from the board side terminal 90, or in other words, when the board 94 is removed from the connector terminal 10, the pressure of the board surface 96 and the conductive surface 92 on the pressing portion 46 is removed with the result that the elastic deformation of the hairpin shaped portion 44 is relieved, and the free state of the spring piece 34 is restored. As a result, the contact portion 48 entirely descends into the slot 22, and is positioned under the slide surface 30. Since the hairpin shaped portion 44 is configured to have a favorable resiliency, the restoring action mentioned above can be achieved in a highly repeatable manner.

Figure 8:
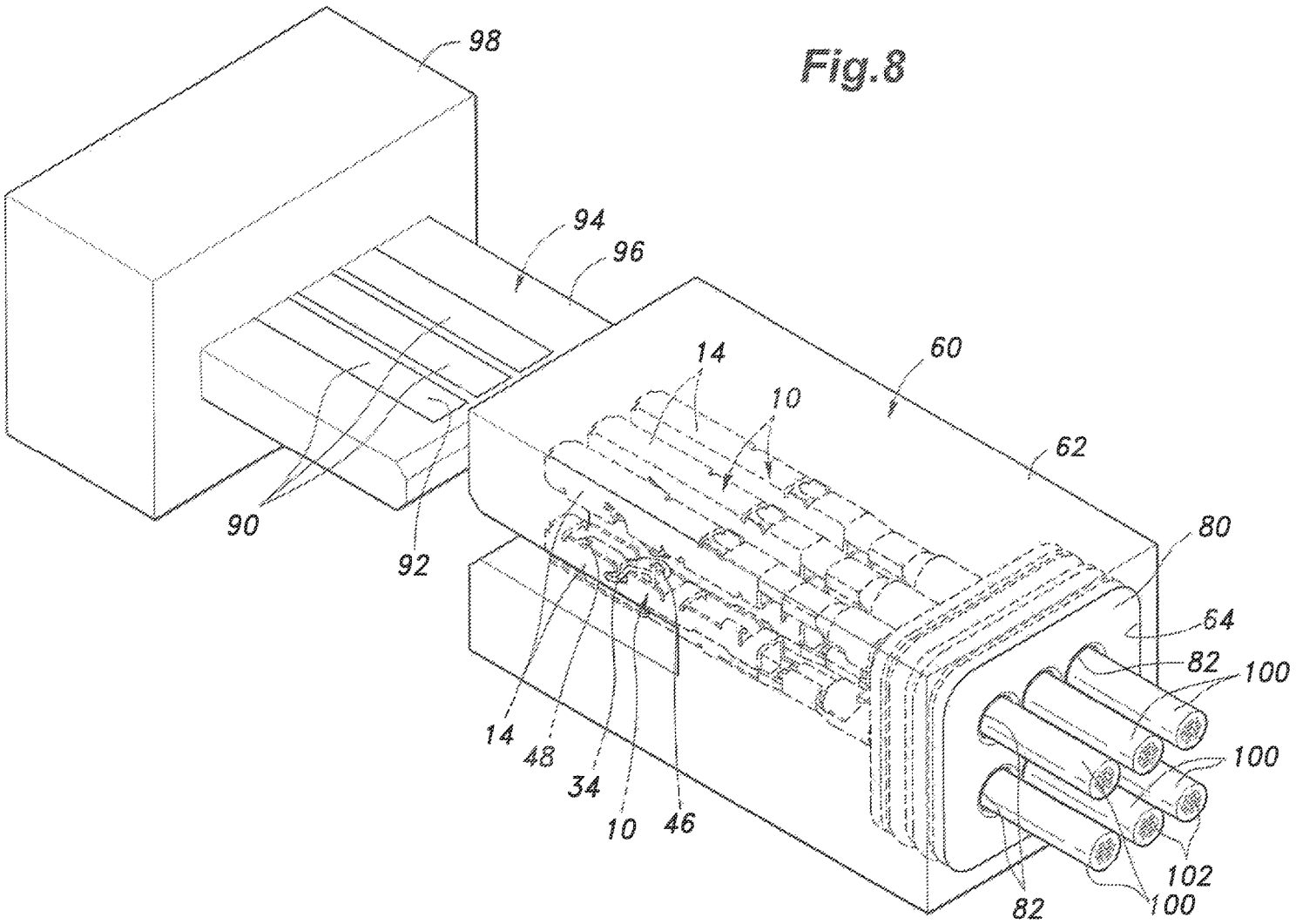
FIG. 8 is a perspective view of a waterproof, multiple pole card edge connector using the connector terminals of the first embodiment.

FIG. 8 shows an example of the card edge multiple pole connector 60 including a plurality of connector terminals 10. The card edge multiple pole connector 60 is provided with a connector housing 62 housing two rows of connector terminals in a mirror image of each other one above the other, each row containing three connector terminals. The connector terminals 10 of the lower row face upward so that the contact portions 48 are located on an upper end side of the housing 14 while the connector terminals 10 of the upper row face downward so that the contact portions 48 are located on a lower end side of the housing 14.

The board 94 may, for example, be that of an electronic control unit 98, and is provided with three board side terminals 90 as card edge terminals on the upper and lower surfaces thereof, respectively. By inserting the edge of the board 94 between the upper connector terminals 10 and the lower connector terminals 10 of the card edge multiple pole connector 60, the upper connector terminals 10 are electrically connected to the board side terminals 90 on the upper surface of the board 94 while the lower connector terminals 10 are electrically connected to the board side terminals 90 on the lower surface of the board 94.

Figure 9:
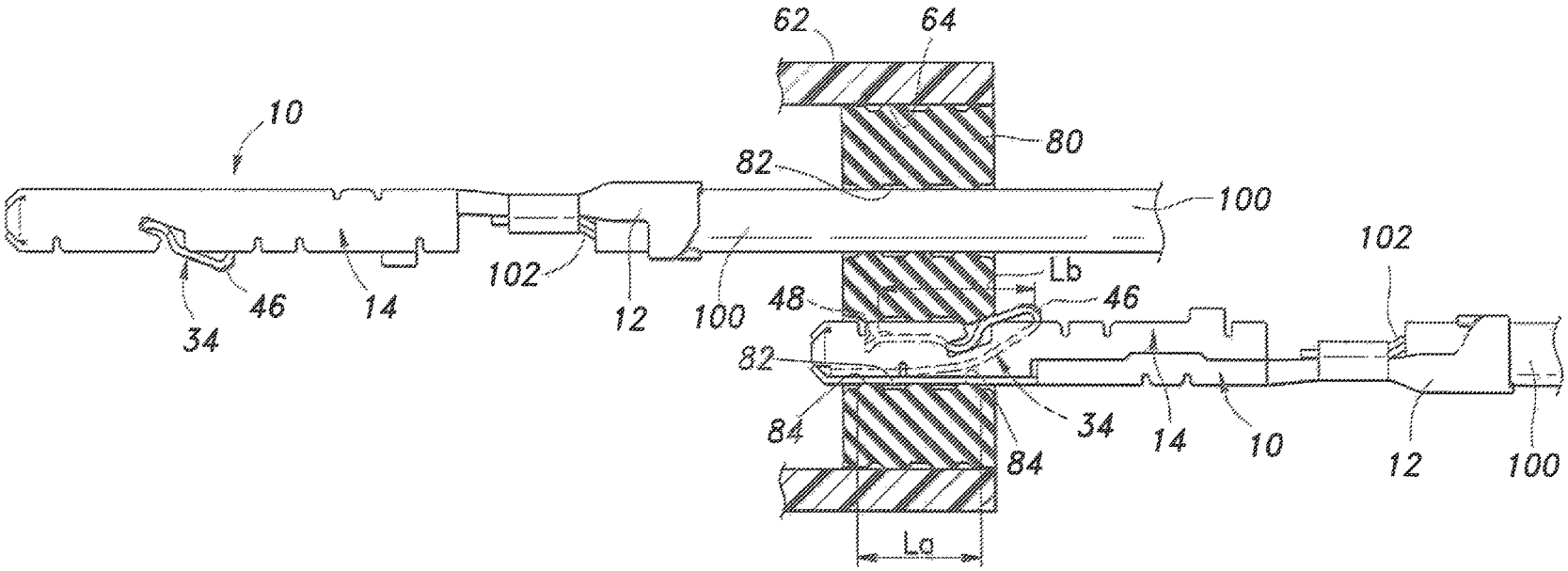
FIG. 9 is a sectional view showing an assembling process of the waterproof, multiple pole card edge connector using the connector terminals of the first embodiment.

When the card edge multiple pole connector 60 is of a waterproof specification, as shown in FIGS. 8 and 9, a rubber seal member 80 is fitted to the connector housing 62 of the card edge multiple pole connector 60 in an air tight manner, and cables 100 each connected to the corresponding connector terminal 10 is passed through an individual insertion hole 82 passed through the rubber seal member 80.

In the assembling process, while the seal member 80 is fitted in a seal mounting opening 64 formed in the connector housing 62, each connector terminal 10 to which the corresponding cable 100 is connected is inserted into the corresponding insertion hole 82 from the front end side of the housing 14 until the cable 100 is positioned in the insertion hole 82 as in the connector terminal 10 shown in an upper part of FIG. 9.

When passing the cable 100 through the insertion hole 82, the housing 14 passes through the insertion hole 82 while pushing out the inner circumferential wall of the insertion hole 82. In this case, the effective axial length La of the insertion hole 82 is smaller than the distance Lb between the pressing portion 46 and the contact portion 48 as measured in the axial direction. Therefore, in the course of passing the housing 14 through the insertion hole 82, by the time the pressing portion 46 starts pressing upon the inner circumferential surface of the insertion hole 82, the contact portion 48 has already passed through and exited the insertion hole 82. The effective axial length La of the insertion hole 82 in this case is defined as the axial distance between axially outermost seal lands 84 that closely contact the cable 100 at the respective axial ends of the insertion hole 82.

Owing to this arrangement, when the contact portion 48 passes through the insertion hole 82, the spring piece 34 remains in the free state as is the case with the lower connector terminal 10 shown in FIG. 9. When the contact portion 48 is passing through the insertion hole 82, the contact portion 48 is entirely received within the slot 22 and is located below the slide surface 30 so that the contact portion 48 does not make any sliding contact with the inner circumferential surface of the insertion hole 82.

Thereby, any foreign matter such as a releasing agent and lubricant that may be adhering to the inner circumferential surface of the insertion hole 82 at the time of installing the seal member 80 is prevented from adhering to the surface of the contact portion 48. In this way, the surface of the contact portion 48 is prevented from being contaminated by impurities so that occurrence of conduction failure due to contamination is avoided, and satisfactory electric connection can be ensured in a reliable manner.

If the elastic force of the seal member 80 is not strong enough to drive the spring piece 34, the dimensional relationship between the effective axial length La and the distance Lb may not be required to be determined as discussed above.

When the pressing portion 46 passes through the insertion hole 82, foreign matter that may have adhered to the pressing portion 46 may be transferred to the conductive surface 92. However, the region of the conductive surface 92 to which the foreign matter is transferred is limited to the region where the pressing portion 46 makes a sliding contact with the conductive surface 92, and does not extend to the region where the contact portion 48 makes a sliding contact with the conductive surface 92. Therefore, occurrence of conduction failure due to contamination is avoided, and satisfactory electric connection can be ensured in a reliable manner.

An example of a method of manufacturing the connector terminal 10 will be described in the following with reference to FIGS. 10 and 11.

Figure 10:
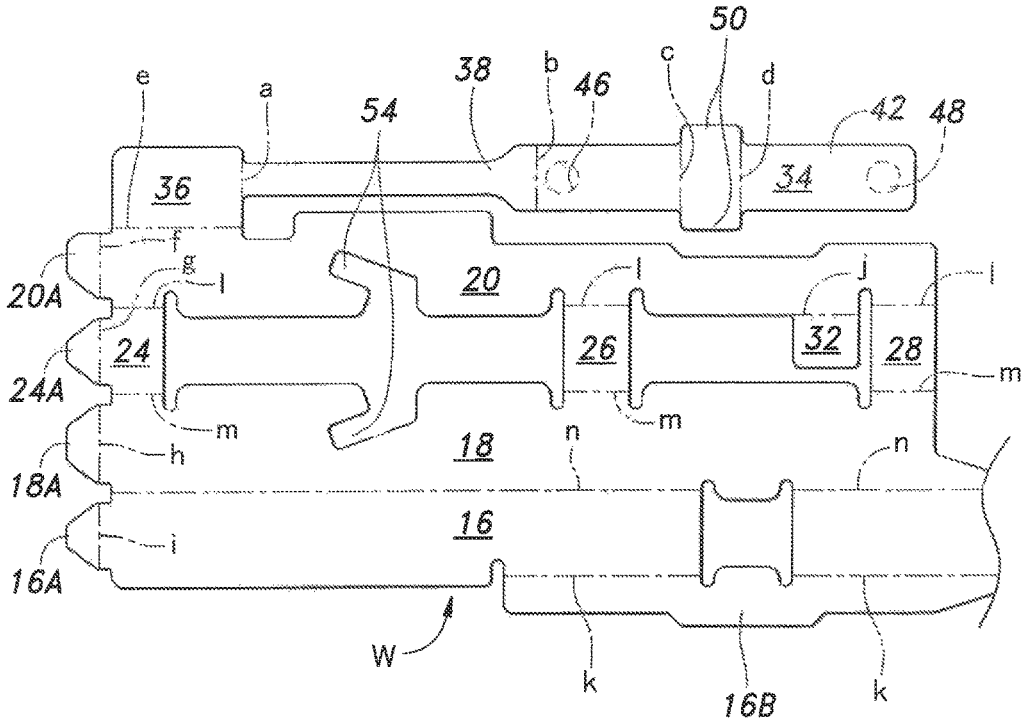
FIG. 10 is a plan view of sheet metal blank used as the material for the connector terminal of the first embodiment.
Figure 11:
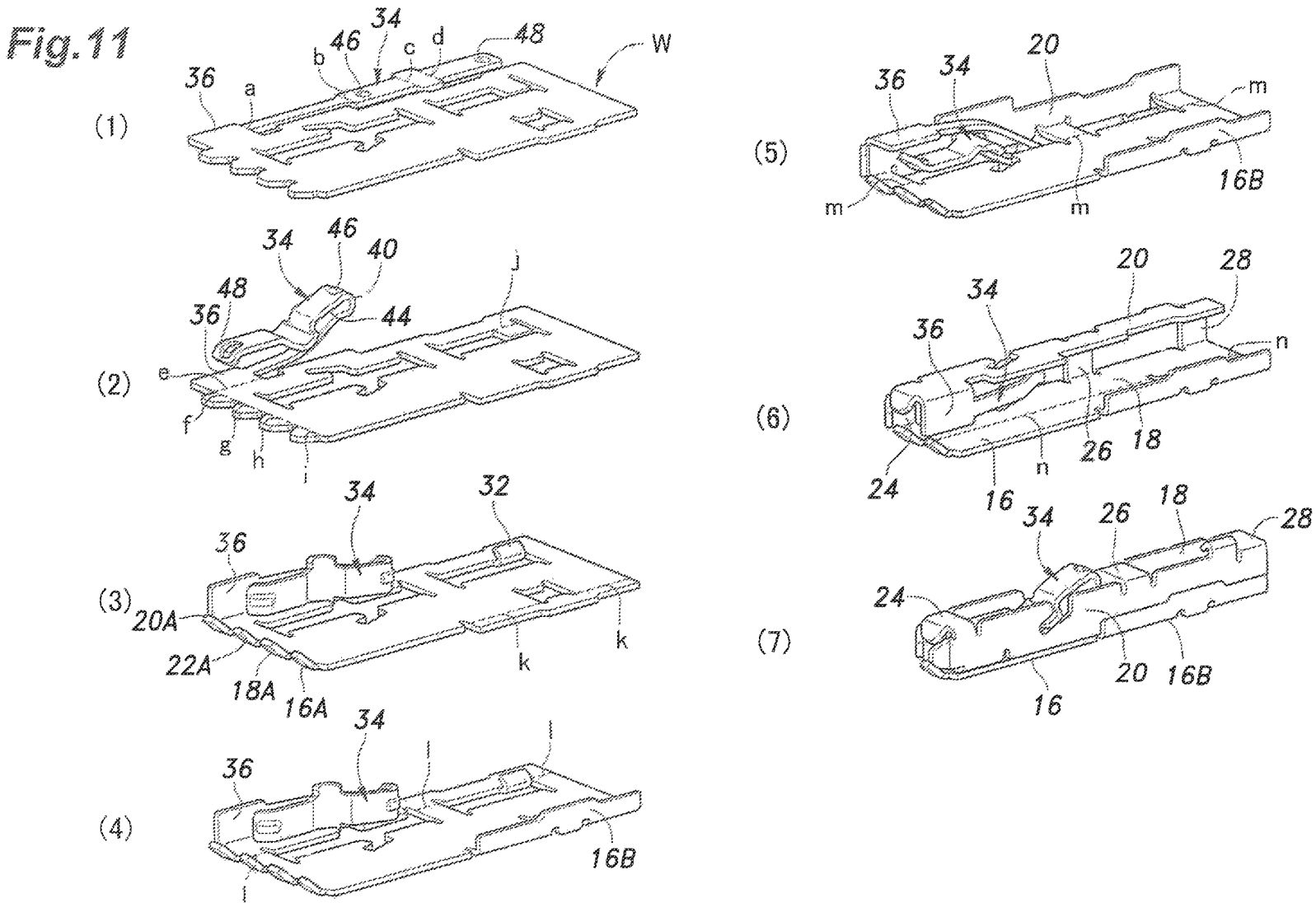
FIG. 11 shows perspective views of various steps in a bending process of the connector terminal of the first embodiment.

The manufacturing method of the connector terminal 10 includes a blanking step of obtaining sheet material blanks W each having a developed flat shape of the entire connector terminal 10 as shown in FIG. 10, and a bending step of bending the blank W along bending lines a to m so as to form the connector terminal 10 as shown in FIG. 11.

The bending step is discussed in more detail with reference to (1) to (7) in FIG. 11. (1) to (7) in FIG. 11 are intended to show the bending directions, and are not necessarily required to be performed as individual steps. For instance, the bending shown in (3) may be performed simultaneously as the bending shown in (4).

The pressing portion 46 and the contact portion 48 are formed by embossing at predetermined parts of the blank W as shown in (1), and the spring piece 34 including the hairpin shaped portion 44 is formed by bending along lines a to d shown in (3) to achieve the state shown in (3).

The front end pieces 16A, 18A, 20A and 24A and the projecting piece 32 as well as the spring piece 34 are formed by bending along lines e to j shown in (2) to put them into the state shown in (3).

The blank W is then bent along line k shown in (3) to form the right side vertical piece 16B as shown in (4).

The blank W is bent along line l shown in (4) to form the left side vertical piece 20 as shown in (5).

The blank W is bent along lines m shown in (5) to form the connecting pieces 24, 26 and 28 as shown in (6).

The blank W is bent along lines n shown in (6) to form the bottom piece 16 and the right side vertical piece 18. Thereby, the base end portion 36 is laid onto the bottom piece 16, and the connector terminal 19 is completed as shown in (7).

As described above, the connector terminal 10 can be manufactured without requiring an assembling step simply by bending a single blank W blanked into a developed shape including the entire connector terminal 10. Therefore, the connector terminal 10 can be produced both efficiently and economically.

Figure 3:
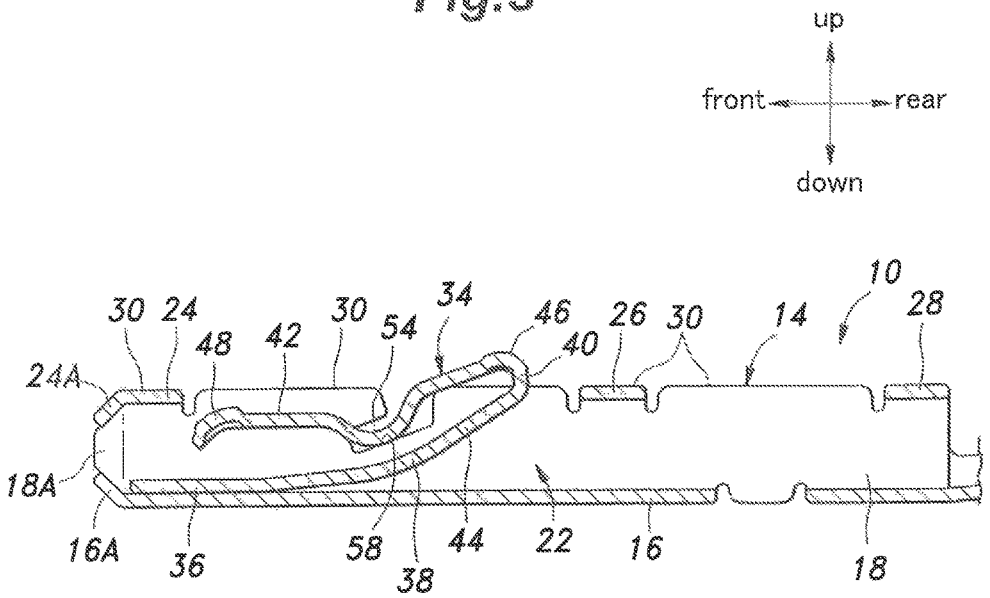
FIG. 3 is a sectional view taken along line III-III of FIG. 2.
Figure 12:
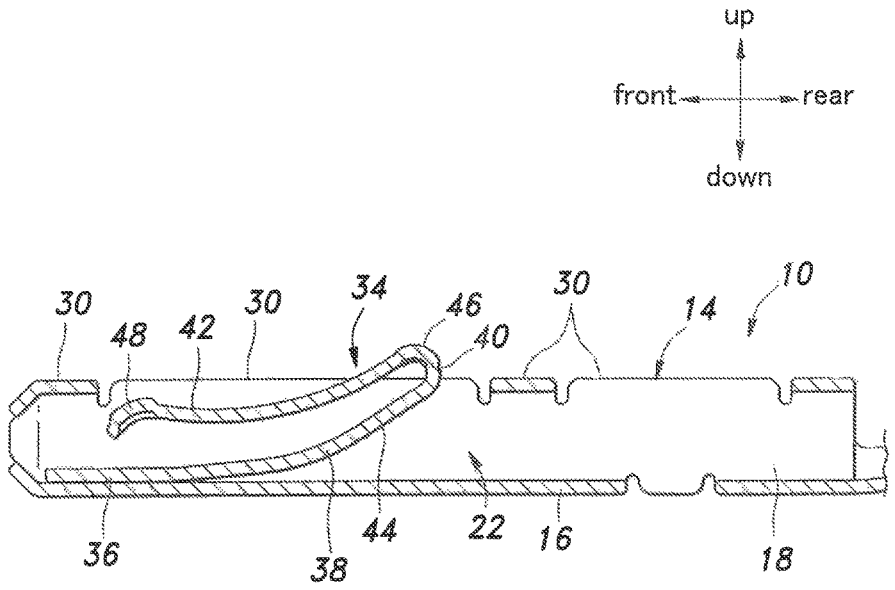
FIG. 12 is a sectional view showing an important part of a connector terminal according to a second embodiment of the present invention.

A connector terminal according to a second embodiment of the present invention will be described in the following with reference to FIG. 12. In FIG. 12, parts corresponding to those in FIG. 3 are denoted with like reference numerals without necessarily repeating the description of such parts.

In the second embodiment, the extension 50 used in the first embodiment is omitted, and the upper piece 42 is formed as a cantilever arm that is not pivotally supported by the housing 14.

In a free state where the hairpin shaped portion 44 is not pressed downward, the pressing portion 46 is located outward of the housing 14, or in other words, above the slide surface 30 as shown in FIG. 12. In particular, the pressing portion 46 interferes with the path of motion of the conductive surface 92. Therefore, when the pressing portion 46 is pressed downward, the pressing portion 46 moves downward owing to the elastic deformation of the hairpin shaped portion 44 or the lower piece 38, and thereby moves into the slot 22.

In the free state where the pressing portion 46 is not pressed downward, the contact portion 48 is entirely received in the slot 22, and is located below the slide surface 30 as shown in FIG. 12. In other words, the contact portion 48 does not interfere with the path of movement of the conductive surface 92. Once the pressing portion 46 is pressed downward, the contact portion 48 moves upward from the slot 22, and is moved to a position located above the slide surface 30. As a result, the contact portion 48 interferes with the path of movement of the conductive surface 92, and resiliently comes into contact with the conductive surface 92 of the board side terminal 90, thereby establishing an electric connection with the board side terminal 90.

Thus, the second embodiment provides functions and advantages similar to those of the first embodiment.

Figure 13:
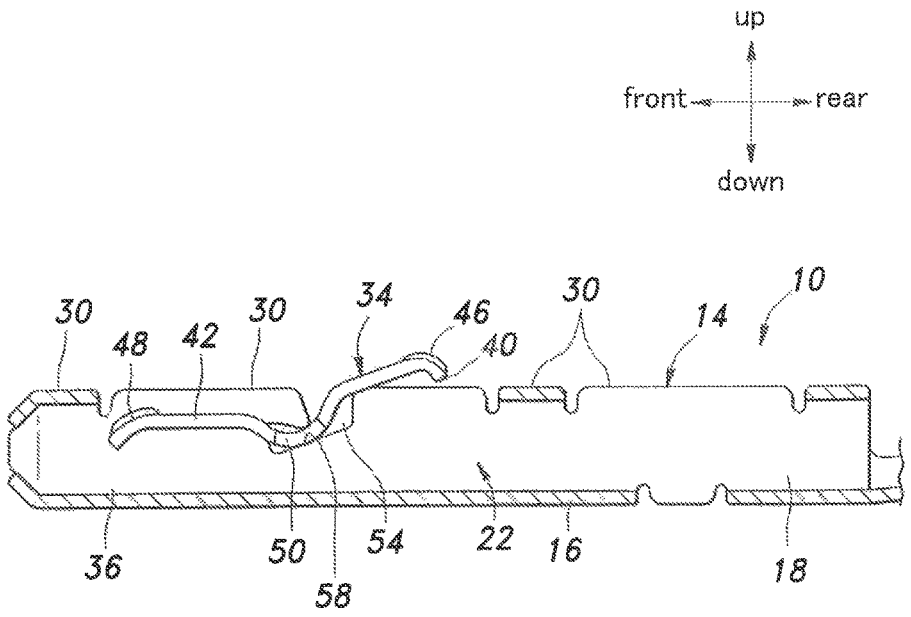
FIG. 13 is a sectional view showing an important part of a connector terminal according to a third embodiment of the present invention.

A connector terminal according to a third embodiment of the present invention will be described in the following with reference to FIG. 13. In FIG. 13, parts corresponding to those in FIG. 3 are denoted with like reference numerals without necessarily repeating the description of such parts.

In the third embodiment, the base end portion 36 and the lower piece 38 of the first embodiment are omitted, and the upper piece 42 is pivotally supported by the housing 14 by the extension 50. The pressing portion 46 and the contact portion 48 serve as two abutting portions provided along the longitudinal direction of the upper piece 42. The upper piece 42 is configured in such a manner that as the upper piece 42 slides along the board side terminal 90, and the conductive surface 92 presses onto one of the abutting portions, the other abutting portion is caused to move into the path of movement of the conductive surface 92. Thereby, the other abutting portion serves as the contact portion for electrically contacting the board side terminal 90.

Thus, as shown in FIG. 13, in the initial state where the pressing portion 46 is not pressed downward, the pressing portion 46 is located outside the housing 14 or above the slide surface 30 as shown in FIG. 13. When the pressing portion 46 which is in the path of movement of the conductive surface 92 is pressed downward by the conductive surface 92, the upper piece 42 undergoes a clockwise rotation around a fulcrum provided by the extension 50 so that the pressing portion 46 moves into the slot 22.

In the initial state where the pressing portion 46 is not pressed downward, the contact portion 48 is entirely received within the slot 22, and is hence located below the slide surface 30 as shown in FIG. 13. In other words, the contact portion 48 does not interfere with the path of movement of the conductive surface 92. Once pressing portion 46 is pressed downward, the contact portion 48 undergoes a clockwise rotation around a fulcrum provided by the extension 50, and moves to a position above the slot 22 or above the slide surface 30. As a result, the contact portion 48 moves into the path of movement of the conductive surface 92 of the board side terminal 90, and resiliently comes into contact with the conductive surface 92, thereby establishing an electric connection with the board side terminal 90.

Thus, the third embodiment provides functions and advantages similar to those of the first embodiment. In the third embodiment, a biasing means such as a spring may be provided for urging the upper piece 42 in a counter-clockwise direction. In this case, the free state of the biasing means provides the initial state. In the third embodiment, it suffices if a conductive connection is made between the spring piece 34 and the housing 4 at the pivot point between the upper piece 42 and the housing 14.

Although the present invention has been described with reference to preferred embodiments thereof, it is to be understood by those skilled in the art that the present invention is not limited by such embodiments, but various modifications can be made without departing from the spirit of the present invention. For example, the positions of the housing 14 and the spring piece 34 can be interchanged so that the pressing portion 46 is in front of the contact portion 48 (in terms of the direction of inserting the connector terminal 10). The spring piece 34 may be bent from the front end of the bottom piece 16 or formed in other ways as long as the spring piece 34 is electrically connected to the housing 14.

GLOSSARY OF TERMS

10 connector terminal
12 cable connecting part
14 housing
16 bottom piece
18 right side vertical piece
20 left side vertical piece
22 slot
24 connecting piece
26 connecting piece
28 connecting piece
30 sliding surface
32 projecting piece
34 spring piece
36 base end part
38 lower piece
40 bent portion
42 upper piece
44 hairpin shaped portion
46 pressing portion (intermediate portion)
48 contact portion (free end portion)
50 extension (intermediate portion)
54 opening (supporting portion)
58 upwardly facing surface (sloping surface)
60 card edge multiple pole connector
62 connector housing
64 seal mounting opening
80 seal member
82 insertion hole
90 board side terminal
92 conductive surface (planar surface)
94 printed circuit board
96 board surface (planar surface)
98 electronic control unit
100 cable
102 conductor

The invention claimed is:

1. A connector terminal configured to be electrically connected to an object terminal by making a sliding engagement with a planar surface including the object terminal, the connector terminal comprising:

a housing configured to slide over the object terminal; and a spring piece connected to the housing, the spring piece including a pressing portion which is configured to be located outside of the housing in a free state of the spring piece, and to move into the housing owing to an elastic deformation of the spring piece when the pressing portion is pressed by the planar surface, and a contact portion which is configured to be located inside of the housing in the free state of the spring piece, and to move out of the housing and make an electric contact with the object terminal as the pressing portion moves into the housing.

2. The connector terminal as defined in claim 1, wherein the object terminal comprises a board side terminal formed in a printed circuit board and having a conductive surface constituting the planar surface.

3. The connector terminal as defined in claim 1, wherein the housing comprises a support portion supporting a portion located between the pressing portion and the contact portion of the spring peace as a fulcrum, the pressing portion serving as an effort point, and the contact portion serving as a load point.

4. The connector terminal as defined in claim 3, wherein the support portion comprises a sloping surface rising toward the pressing portion of the spring piece, and the spring piece is pivotally supported by the housing at an intermediate portion of the spring piece serving as a fulcrum and located between the pressing portion and the contact portion, and slidably engaged by the sloping surface.

5. The connector terminal as defined in claim 4, wherein the housing comprises a rectangular bottom piece and a pair of side vertical pieces extending along either side edge of the bottom piece, and the support portion comprises an opening provided in each side vertical piece, and the intermediate portion of the spring piece comprises an extension extending laterally from the spring piece and engaged by the opening.

6. The connector terminal as defined in claim 1, wherein the pressing portion is configured to serve as an additional contact point for electric contact with the object terminal when the pressing portion is pressed by the planar surface.

7. The connector terminal as defined in claim 1, wherein the housing comprises a slot defined by a rectangular bottom piece and a pair of side vertical pieces extending along either side edge of the bottom piece, the contact portion being configured to be received in the slot in the free state of the spring piece.

8. The connector terminal as defined in claim 1, wherein the spring piece comprises a base end portion fixedly attached to the housing, and extends from the base end portion toward the pressing portion in a sliding direction in relation to the object terminal, and is folded back so as to extend from the pressing portion to the contact portion in an opposite sliding direction in relation to the object terminal.

9. The connector terminal as defined in claim 1, wherein the housing and the spring piece are formed as a single integral member.

10. A method of manufacturing the connector terminal as defined in claim 1, comprising:

a blanking step of blanking a sheet material into a blank having a developed flat shape containing an entirety of the connector terminal; and a bending step of bending the blank into the connector terminal.

* * * * *